United States Patent [19]

Riblet

[11] 3,970,277

[45] July 20, 1976

[54] SCAFFOLD BRACKET

[76] Inventor: Henry J. Riblet, 87 Crescent Road, Needham, Mass. 02194

[22] Filed: Oct. 15, 1974

[21] Appl. No.: 514,583

[52] U.S. Cl. ..... 248/246; 182/136

[51] Int. Cl.[2] ..... A47B 47/00

[58] Field of Search ..... 248/246, 125, 221; 254/29 R; 182/136, 133, 101

[56] References Cited

UNITED STATES PATENTS

| | | | |
|---|---|---|---|
| 1,416,296 | 5/1922 | Hoitsma | 182/136 |
| 1,441,806 | 1/1923 | Hoitsma | 182/136 |
| 2,038,899 | 4/1936 | Hoitsma | 182/136 X |
| 2,216,912 | 10/1940 | Hoitsma | 182/136 |
| 2,854,293 | 9/1958 | Riblet | 248/246 X |
| 3,473,774 | 10/1969 | Riblet | 248/246 |

FOREIGN PATENTS OR APPLICATIONS

| | | | |
|---|---|---|---|
| 778,528 | 7/1957 | United Kingdom | 182/133 |
| 790,662 | 2/1958 | United Kingdom | 248/221 |

*Primary Examiner*—J. Franklin Foss

[57] ABSTRACT

An improved self-locking scaffold bracket employing a load activated lock in combination with a foot operated hoisting device which may be hoisted without lost motion relative to the support. The scaffold bracket utilizes a rigid frame directly supported upon a lock which clamps to an upright post. The scaffold can be raised by a hoisting device of the block and tackle type or by a foot operated hoisting mechanism of the type which "walks" up the post. The hoisting device engages the lock in a manner causing the lifting force to be exerted at a trunnion axis of the lock which is so situated that it eliminates lost motion and tilting during the hoisting operation.

9 Claims, 11 Drawing Figures

14a
14
15
16
16a
17
13
12a
32
23
13a
25
31
26
15a
12
21
28
11
24
27
29
30
19
20
10
18
U1
22
18a
22a
18b

F
$F_L$
26
KF
X
23
$a_v$
$L_1F_c$
Fa
32
$F_c$
b
M Fa
$F_b$
27
$\mu F_b$ 23
23c
23a
24
34
50

46
46a
42
52
49
43
47
54
48
41
41a
51
47a
50
47
51
51a
46
54
42
48
52
52a
49
48
53
41a
47A
50
50a
41
44

44a
51

56
59
55
57
24

Fig 11.
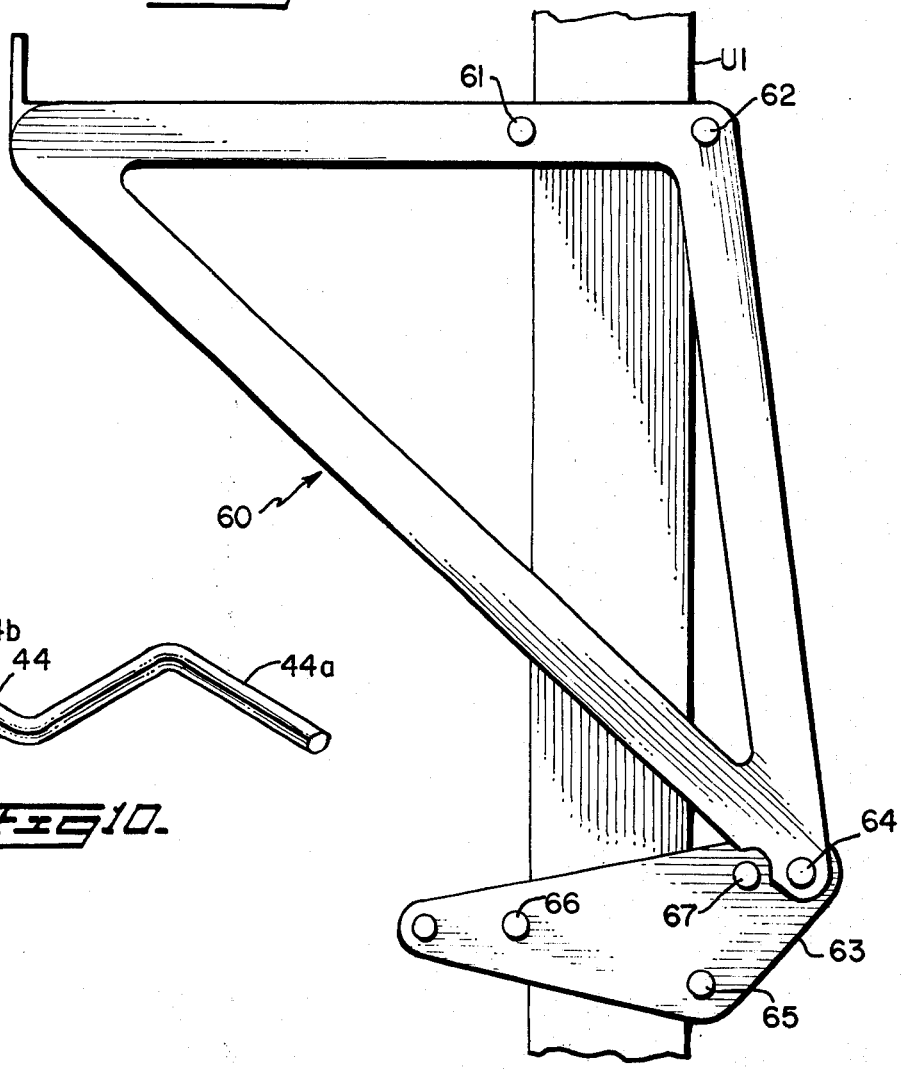
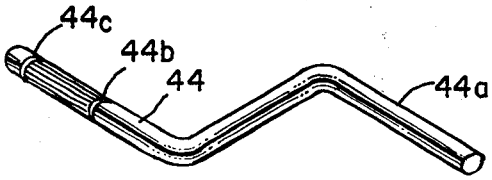
Fig 10.
Fig 9.
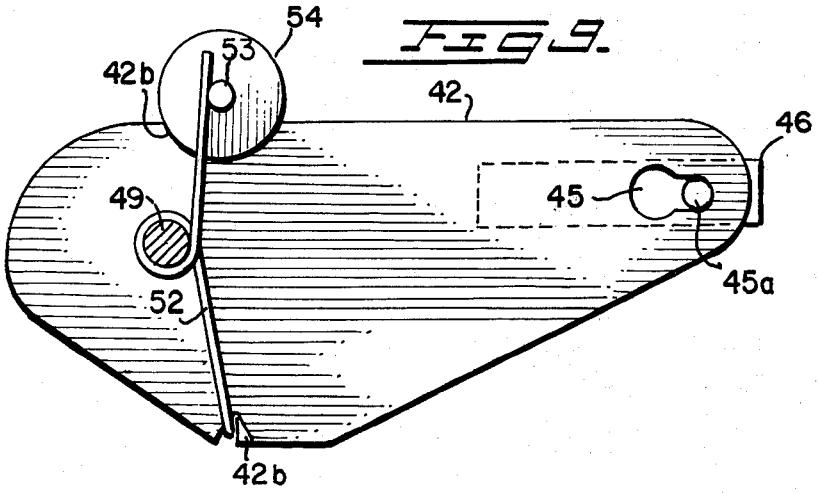

SCAFFOLD BRACKET

FIELD OF THE INVENTION

This invention relates in general to scaffolds of the type having a platform supported on brackets attached to upright posts in a manner permitting the height of the platform to be changed. More particularly, the invention pertains to an improved platform supporting bracket employing a load activated lock which permits the platform to be raised safely and without appreciable lost motion by a foot operated hoisting device or block and tackle.

DISCUSSION OF THE PRIOR ART

It has been the general practice in the employment of scaffold brackets of the type shown in U.S. Pat. No. 2,342,427 to span a pair of spaced uprights with a platform supported upon brackets that are secured to the uprights. Each upright is commonly provided with a device enabling the platform and its supporting brackets to be raised or lowered by workmen on the platform. The conventional hoisting apparatus has been a block and tackle suspended from the top of the upright. The block and tackle method of adjusting the height of the platform is not suitable where the platform is heavily loaded. The lifting of a heavily loaded platform is more easily accomplished by a device which provides a greater mechanical advantage than the simple block and tackle.

In U.S. Pat. Nos. 1,441,806 and 2,038,899 foot operated hoisting mechanisms are described which permit workmen on a bracket supported scaffold to raise the platform. The foot operated hoisting mechanisms there described obtain their lifting force by having the operator exert his weight on a lever by stepping onto a stirrup. The foot operated hoisting mechanisms of the prior art are not intended to be used in conjunction with a platform bracket using a load-activated lock but rather are intended for use with locks of the type employing springs to provide the force causing the jaws of the lock to reengage the uprights at the end of the lifting stroke.

OBJECTS OF THE INVENTION

It is an object of the invention to provide an improved scaffold bracket, employing a load-activated lock of the kind described in U.S. Pat. No. 2,342,427, which in combination with a foot-operated hoisting device, may be hoisted in a preferred version without lost motion.

Another object of the invention is to provide an improved scaffold bracket with means whereby it may be hoisted either by a foot-operated hoisting device or by a block and tackle without lost motion.

Another object of the invention is to provide a foot-operated hoisting device acting in combination with a scaffold bracket employing a load-activated lock with means whereby the combination may be raised and lowered by a block and tackle.

With the above and other objects in view, the present invention consists of the combination and arrangement of parts hereinafter more fully described, illustrated in the accompanying drawings and more particularly pointed out in the appended claims, it being understood that changes may be made in the form, size, proportions, and minor details of construction without departing from the spirit or sacrificing any of the advantages of the invention.

GENERAL DESCRIPTION OF THE DRAWINGS

Figure 3:
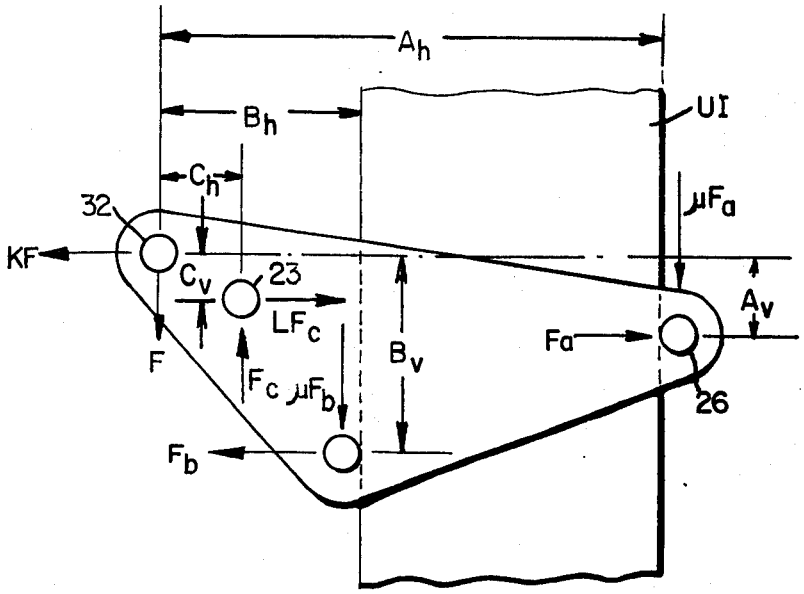

FIG. 3 schematically depicts the forces acting on the improved lock when it is being lifted by a hoisting attachment.

Figure 4:
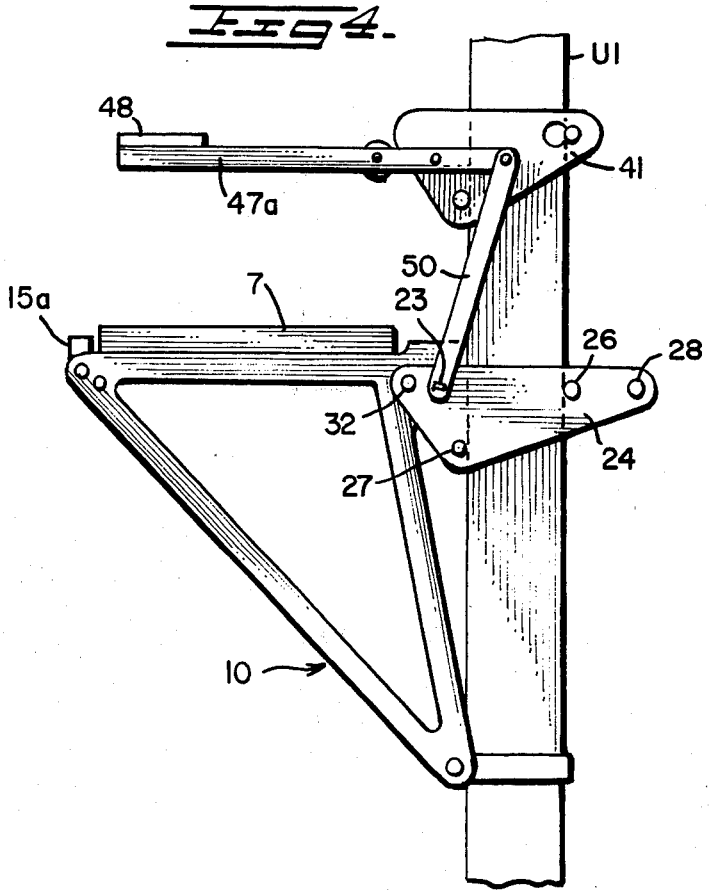

FIG. 4 is an elevational view showing the foot operated hoist attached to the scaffold bracket.

Figures 5, 6, 7, 8:
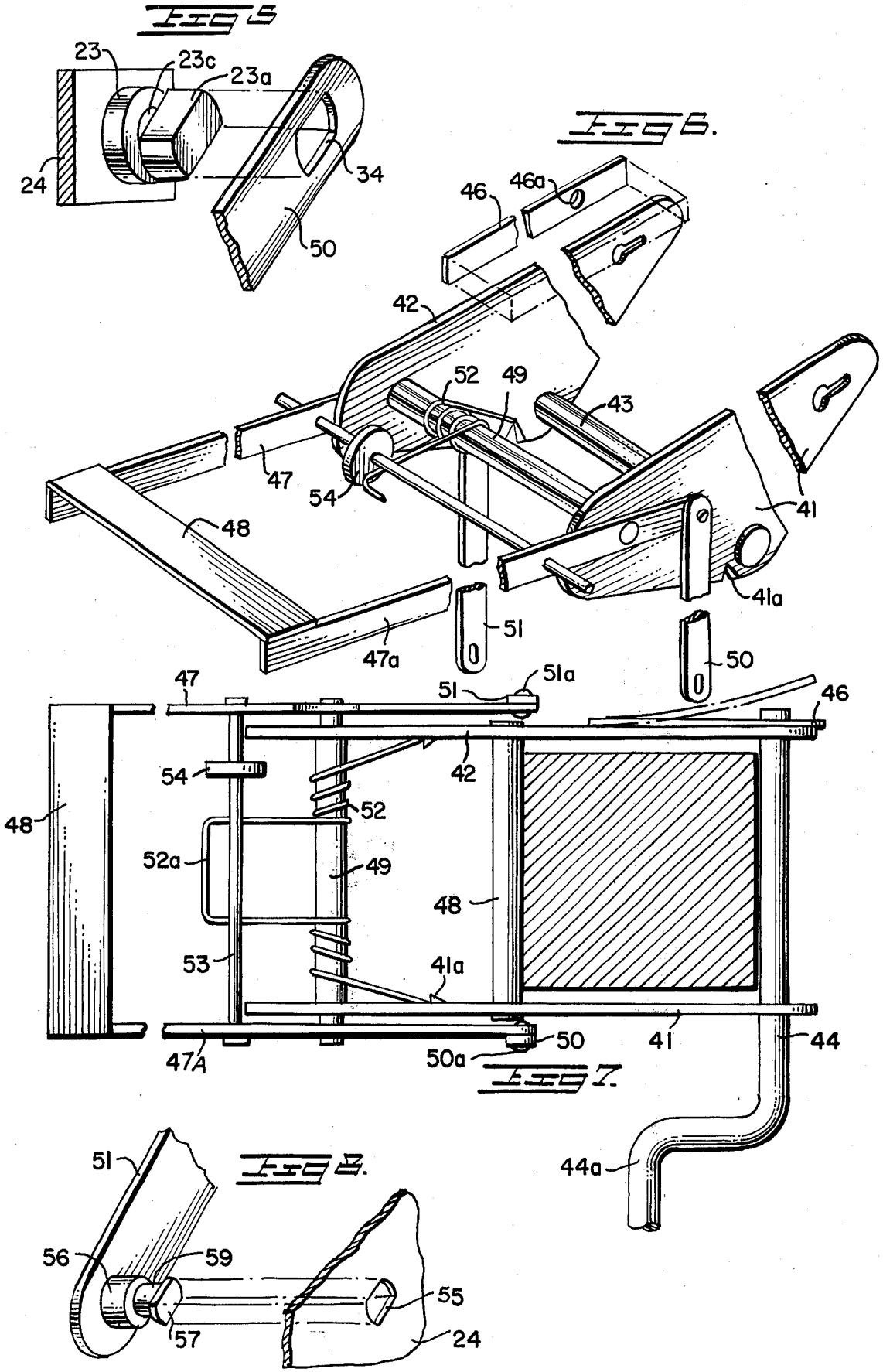

FIG. 5 shows details of a trunnion bar to which the hoisting attachment can be connected.

FIG. 6 is a perspective view of the preferred embodiment of the foot operated hoist.

FIG. 7 is a top plan view of the foot operated hoist clamped to the upright.

FIG. 8 shows an alternate arrangement for attaching a removable hoisting attachment to the trunnion axis.

FIG. 9 depicts the details of the side plate employed in the foot operated hoisting device.

FIG. 10 depicts a version at the outer jaw at the foot operated hoist.

FIG. 11 depicts an embodiment of the invention in which the load activated lock is situated at the bottom of the bracket.

DETAILED DESCRIPTION OF THE INVENTION

Figure 1:
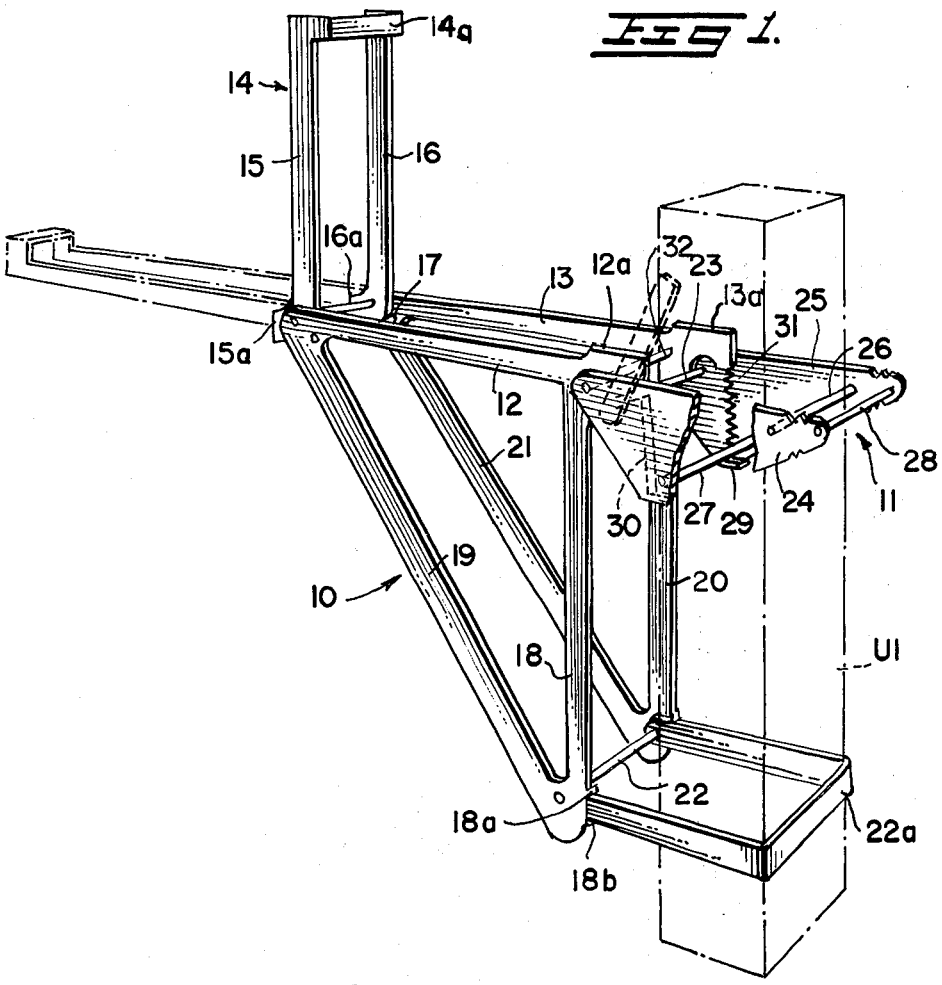
FIG. 1 is a perspective view of the preferred form of the platform supporting bracket employed in the invention.

The perspective view of FIG. 1 depicts a platform supporting bracket having provisions, in accordance with the invention, for the attachment of a hoisting mechanism. The bracket employs a platform supporting frame 10 supported upon a lock 11 arranged to clamp to an upright U1. The frame 10 employs a pair of rigid, generally triangular, members arranged side by side to provide rails 12 and 13 for supporting the platform on the scaffold. To prevent the platform from moving against the face of upright U1, rails 12 and 13 have raised tabs **12*a* and 13*a*** which act as stops.

To accommodate a wider platform, rails 12 and 13 can be lengthened by moving a pivoted member 14 from the position where it is nested between rails 12 and 13 to the position where its rails 15 and 16 form extensions of the rails 12 and 13. In the extended position of member 14, stops **15*a* and 16*a* bear upon a rod 17 and the raised heel 14*a* provides an abutment to prevent the plank from slipping off. In the nested position, rails 15 and 16 rest upon fulcrum rod 32 and stops 15*a* and 16*a* prevent the plank 7 from slipping off. Rail 12 is part of a rigid triangular structure having legs 18 and 19 as its other sides. Rail 13 is part of a rigid triangular structure having legs 20 and 21. The two rigid, generally triangular structures, side by side, form the basic platform supporting frame. A rod 22 is disposed at the lower end of the frame to bear upon the face of the upright U1. A roller may be provided on the rod so that the roller can turn to permit rolling action upon the face of the upright U1, where it is desired to facilitate raising and lowering of the bracket. To hold the lower end of the rigid frame in appropriate relation to the upright, a yoke 22*a* is mounted upon the rod 22. To prevent yoke 22*a* and rod 22 from accidentally clamping the upright when the position of the scaffold bracket is changed, the yoke is limited in pivotal movement by confining it between tabs, such as tabs 18***a* and 18*b* on the leg 18.

The platform supporting frame 10 is supported upon the lock 11 in a manner permitting the lock to pivot relative to the frame about a fulcrum "rod" 32 extending between rails 12 and 13, as described in my U.S. Pat. No. 2,342,427. The locking device employs a pair of spaced plates 24 and 25 having an outer jaw 26 and an inner jaw 27 attached to the plates in a manner permitting the upright U1 to be received between the jaws with the plates on opposite sides of the upright. The plates 24, 25 have portions extending beyond the outer jaw 26 which support an interposed bar 28 whose purpose is later explained. Adjacent the jaw 27, each of the plates 24, 25 is provided with a lateral tab, such as the tab 29. Tension springs 30 and 31 may be secured to those lateral tabs and are attached to the rigid frame. If employed, the springs apply lifting forces to the lateral tabs which tend to pivot the lock about the axis of fulcrum rod 32 in the counterclockwise direction, as viewed in FIG. 1. The spring lifting forces always add to the counterclockwise torque on the lock exerted by the load on the platform as described in U.S. Pat. No. 2,342,427. Springs 30 and 31 are secured to portions of the rails 12 and 13 so as to extend over the trunnion bar 23 positioned in advance of pivotal axis formed by fulcrum rod 32. The pivotal axis formed by fulcrum rod 32 is situated in relation to outer jaw 26 so that when the upright U1 is clamped between the inner and outer jaws, the fulcrum rod 32 is even with or above a horizontal line passing through the line of contact between jaw 26 and the adjacent face of upright U1. The inner jaw 27 is disposed below the pivotal axis and the downward oblique force exerted by the load on platform 7 upon the fulcrum rod 32 results in an opposing force on the outer jaw 26 to cause the lock to engage the upright U1 as described in my U.S. Pat. No. 2,342,427. Once engaged, the greater the downward oblique force on the pivotal axis, the greater is the clamping force exerted on the upright U1.

Disposed between the fulcrum rod 32 and inner jaw 27 is a trunnion bar 23 whose ends protrude through apertures in the plates 24 and 25. The trunnion bar, preferably, is arranged so that it cannot rotate relative to plates 24 and 25. The introduction of the trunnion bar 23 between pivotal axis 32 and inner jaw 27 results in an improvement upon my prior invention described in U.S. Pat. No. 2,342,427. The proper location of the trunnion axis can essentially eliminate lost motion due to the opening of the lock on the upright when the platform is hoisted by applying lifting forces at the trunnion axis. Upon relaxation of the lifting forces, the weight on the platform causes the lock to immediately reassert its grip upon the upright. The platform, therefore, is held in place on the upright and there is no loss in height due to the opening of the lock during the hoisting operation.

Figure 2:
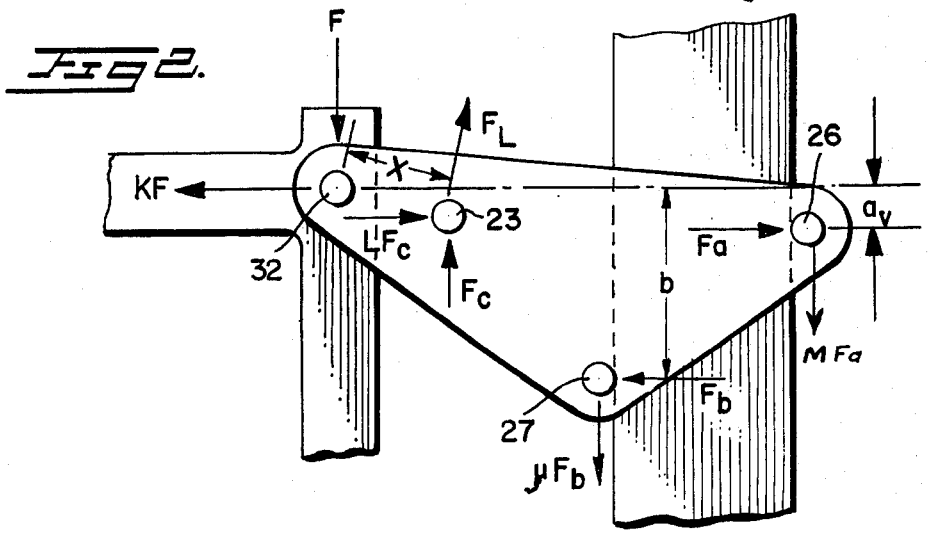
FIG. 2 illustrates the attitude of the improved lock of the invention when a lifting force sufficient to move the bracket upward is applied at the trunnion axis.

By providing a trunnion axis 23 as in the FIG. 1 embodiment and placing that axis at an appropriate location between the fulcrum rod 32 and the inner jaw 27, lost motion can be so greatly minimized as to be negligible. This action can be better appreciated from a consideration of FIG. 2 which depicts the improved lock upon the upright U1. The following equations, which appear below, are familiar to those skilled in the art:

$F_x = 0$ $F_y = 0$ $M_o = 0$

The force $F_a$ between jaw 26 and upright U1 (aided by any existing friction), exerts a counterclockwise torque which causes the inner jaw 27 to engage the upright U1 and clamp the upright U1 between the inner jaw 27 and the outer jaw 26. Thereafter, the greater the load on the platform, the greater is the clamping force on the upright.

Where a lifting force $F_c$ applied to the trunnion axis 23, is greater than the downward force F exerted upon the fulcrum 32 by the load on the platform, the lock will tend to be pulled upwardly. However, because jaws 26 and 27 are in contact with the faces of upright U1, frictional forces $uF_a$ and $uF_b$ are created which together with $F_b$ tend to swing the lock clockwise as viewed in FIG. 2. When that clockwise torque is countered by the torque exerted by the oblique upward force $F_L$ acting at the distance X from the fulcrum 32 and by the torque of $F_a$ acting about that fulcrum through the movement arm $a_v$, and when the vertical component $F_c$ of the force $F_L$ is greater than the sum of the downward forces F, $uF_b$, and $uF_a$, the lock is pulled upwardly with the jaws 26 and 27 riding over the faces of the upright. Upon removal of the upward $F_L$ force, the downward F force causes the jaws 26 and 27 to immediately clamp the upright. Inasmuch as those jaws are in contact with the upright, there is no perceptible lost motion before an effective clamp is obtained upon the upright by the jaws.

FIG. 5 shows a detail of one end of trunnion bar 23 of the FIG. 1 embodiment, it being understood that the opposite end of the trunnion bar is similarly fashioned. The end of the trunnion bar is a cylinder having two parallel flats 23*a*, 23*b*. A short distance from the end of the bar, the cylinder is reduced in diameter to form a circular slot 23*c*. A member 50 having an aperture 34 corresponding to the shape of the trunnion end, can be mounted upon the trunnion by aligning the aperture to permit the member to slip over the end of the trunnion and seat in the circular slot 23*c*. By rotating the member 50 to cause the aperture to be misaligned, the member 50 can pivot upon the trunnion and is prevented from inadvertently slipping off the end of the trunnion bar.

FIG. 8 shows an alternate arrangement in which the shaped hole 55 is provided on the trunnion axis 23 in the side plates 24 and 25 and the straps 50 and 51 are provided, at their extremities, with shaped bases 56 which will engage the holes 55 in one orientation but cannot be disengaged when the foot operated hoist is fastened to the upright.

The hoisting mechanism shown in the embodiments of FIGS. 6, 7, 9 and 10, is arranged to be attached at the trunnion axis on the scaffold bracket and to be fastened to the upright U1 without having to slip the hoisting mechanism over the end of this upright. The hoisting attachment employs a pair of spaced plates 41, 42 to which an inner jaw 43 is attached and in which an outer jaw 44 may be journalled for rotation. The outer jaw 44 may be provided with a crank arm 44*a* which may be manually turned. As shown in FIG. 10, the outer jaw 44 has two circular grooves 44*b* and 44*c* which are formed by reducing the diameter of the rod. The plates 41 and 42 are similar and, therefore, only one plate need be described in detail. The plate, as shown in FIG. 9, has an aperture 45 to receive the outer jaw 44. The aperture 45 has a narrowed portion 45*a* into which the grooved portion of the outer jaw can fit.

To assemble the outer jaw to the plates, the jaw is inserted endwise through the apertures 45 and is then moved transversely to cause the grooves 44*b* and 44*c* to ride into the narrowed portion 45*a* of the apertures in the plates. The outer jaw 44 is locked in the assembly by a leaf spring 46 (FIG. 7) on the plate 42 which prevents the jaw end from moving back into the larger aperture 45. The leaf spring 46 has circular opening 46*a*, as shown in FIG. 6, to receive the end of jaw 44. To disassemble the jaw from the plates, the leaf spring, which protrudes beyond the end of plate 42 is bent back, as indicated in phantom in FIG. 7, to permit the jaw 44 to move into the larger opening 45 through which the jaw can then be withdrawn. It is clear that a similar result could be achieved with a nut and bolt.

A pair of levers 47 and 47*a*, which are joined at one end by a stirrup 48, are mounted to pivot about an axle 49 extending between plates 41 and 42. Pivotally attached to the ends of the levers are a pair of lifting straps 50, 51. Straps 50 and 51 have means for attaching them to the trunnion axis on the scaffold bracket as previously shown in FIGS. 5 and 8.

Disposed about the axle 49 is a spring 52 having its ends anchored upon the plates 41, 42 and having its center loop 52*a* engaging the underside of a rod 53 extending between levers 47, 47*a*. As a matter of convenience in anchoring the ends of spring 52, each of the plates has a tab 41*a* or 42*a* bent out from the plate which is engaged by the end of the spring. The spring exerts a force on the tabs tending to rotate the plates 41, 42 about axle 49 in the direction which brings the outer jaw 44 toward the pair of levers 47 and 47*a* and ultimately upwardly against the face of the upright U1. As viewed in FIG. 6, the spring force causes counterclockwise rotation of the plates about axle 49. [To nullify the effect of the spring, a stop member 54 is arranged on rod 53 to permit it to be slid into engagement with a notch 42*b* in plate 42. When so engaged in the notch, the lever 47 is forced by spring 52 against plate 42 and the levers and plates then move as a unit. In this restrained condition, the levers can be swung upon the pivots 50*a*, 51*a* into a position where the levers are nearly parallel to the upright U1 and the jaws 43, 44 cannot exert any clamping action upon the upright U1. With the jaws 43, 44 disabled from clamping the upright U1, the platform can be raised and lowered by block and tackle or other positive means by unlocking lock 11.]

To permit the platform to be lowered by a worker when on the platform, [the stop member 54 is disengaged from notch 42*b* to permit jaws 43, 44 to clamp the upright U1.] The workman may rotate the crank 44*a* while holding the lock 11 unlatched by exerting his weight upon bar 28. Rotation of crank 44*a* causes the serrated outer jaw 44 to roll down upon the face of the upright and the rate of descent is then easily controlled. By removing his weight from the bar 28, the workman permits the lock to immediately clamp to the upright U1 and further downward movement of the scaffold platform is then prevented. In the event that outer jaw 44 is replaced by a simple bolt, he may pump the bracket down step by step alternately unlocking locks 41 and jaws 42 and 44. To raise the platform the workman on the platform applies his weight upon the stirrup 48 to cause the levers 47, 47*a* to rotate about axle 49. The downward force exerted upon axle 49 causes the upright U1 to be securely clamped between inner jaw 43 and outer jaw 44 of this hoisting attachment. The levers, consequently, pivot about the axle 49 and raise the straps 50, 51 which are attached to the trunnion axis of the lock 11. The upward force exerted at the trunnion axis by the straps permits the lock 11 to relax its grip upon the upright U1 and move upwardly on the upright in this preferred version. When the trunnion axis is located sufficiently forwardly of fulcrum shaft 32, the counterclockwise torque exerted by the forces $F_L$ and $F_a$ (FIG. 2) about the fulcrum 32 just offset the clockwise torque about the fulcrum due to the frictional forces $uF_a$ and $uF_b$ and $F_b$ with the result that jaws 26 and 27 remain in contact with the adjacent faces of the upright while the lock is pulled upwardly whereby the lock 11 can immediately restore its grip upon the upright at the end of the upward movement of the stirrup end of levers 47, 47*a*. There is no tendency for the platform to move down the upright when the upward force $F_L$ is removed inasmuch as both jaws of the lock are already in contact with the upright and immediately reassert their grip upon that post. Thus, "lost motion" during the hoisting operation is eliminated. With the grip of lock 11 restored upon upright U1, the stirrup can be raised to position levers 47, 47*a* for the next hoisting stroke. Upon lifting the stirrup, the levers swing upon the pivots 50*a*, 51*a* and carry the plates 41 and 42 upwardly relative to upright U1 while jaws 44 and 48 are kept in contact with the upright by spring 52. This hoisting attachment is thereby repositioned a higher level upon the upright and the workman can then place his weight onto the stirrup for the next hoisting stroke. By successive strokes, the scaffold platform together with the load upon it can be raised in increments with relative ease due to the mechanical advantages provided by the levers 47, 47*a*. The limit of downward movement of the stirrup occurs when the levers strike the platform and the workman at that time has his weight over the platform.

The hoisting mechanism is readily attached to the scaffold by slipping the lifting straps 50, 51 (FIG. 6) over the ends of the trunnion bar in the manner indicated in FIG. 5 or in FIG. 8. When the straps are seated in the circular slots (23*c* in FIG. 5) of the trunnion bar, the hoisting mechanism is swung upwardly so that the straps cannot slip off the ends of the trunnion bar. With the jaw 44 removed, as in FIG. 6, the side plates 41, 42 are caused to straddle the upright post, as in FIG. 7, and the jaw 44 is then inserted through the openings 45 (FIG. 8) in the side plates and locked in position by the leaf spring latch 46 as indicated in FIG. 9. With the upright situated between the side plates 41, 42 and between this jaws 43, 44, the hoisting mechanism cannot be inadvertently detached from the ends of the trunnion bar because straps 50 and 51 cannot be lowered to a position where the straps can slip off the ends of the trunnion bar.

To detach this hoisting mechanism, the leaf spring 46 is bent, as indicated in phantom in FIG. 7, to permit the outer jaw 44 to be moved into the larger diameter apertures 45 in plates 41, 42. The outer jaw is pulled endwise through the apertures, leaving open one end of the quadrangle formed by the plates 41, 42 and jaws 43, 44. The attachment is then swung clear of the upright U1 into a position where lifting straps 50, 51 have this apertures in their lower ends aligned to permit those straps to slip over the ends of the trunnion bar. The hoisting attachment is then freed by detaching the straps from the trunnions. The structure of the journalled outer jaw described is one example of an attaching means. The outer jaw could obviously be a simple bolt and nut.

FIG. 7 is a top view showing the foot operated hoist of FIGS. 6 and 7 attached to the improved lock of FIG. 1. For reasons of safety, it is preferred that the stirrup 48 not extend beyond the platform on the bracket. However, this is not essential. Should the workman's foot slip off the stirrup, however, his weight will be over the platform and he is then not apt to fall off the platform. Where the stirrup extends beyond the platform, the danger of a fall is evident.

The trunnion attachment shown in FIG. 5 can be replaced by equivalent arrangements since it is evident that the trunnion bar 23 merely serve as conveniences for applying a lifting force at the trunnion axis. An example of how the trunnion bar can be replaced by holes 55 in plates 24 and 25 and an axle 56 is shown in FIG. 8. Axle 56 has a groove 59 and non-circular head 57 which is received in oblong hole 55 in plate 24. Other ways of attaching hoisting devices to the lock to exert a lifting force at the trunnion axis can readily be devised. The attachment means must, however, allow the lock to pivot to some extent around the trunnion axis so that the connection cannot be a completely rigid one.

The location of the trunnion axis 23 with respect to the fulcrum rod 32 is highly important since it determines whether or not the lock will open when the platform is raised by applying an upward force at the trunnion axis. It is the essence of a preferred version of this invention that a set of dimensions for the relative location of the fulcrum rod 32, inner jaw 27, outer jaw 26 and trunnion axis 23 can be found so that over the range of upright sizes and coefficients of friction ordinarily encountered, there will be little or no opening of the lock when K and L vary within certain limits. Here K is the ratio of the horizontal component to the vertical component of the force exerted on the fulcrum rod by the load on the bracket. When the load falls midway along the rails 12 and 13 of the bracket, $K \simeq 0.375$, whereas when the pivoted member 14 in its extended position and the load is midway between the heel 14*a* and the raised tabs 12*a* and 13*a*, $K$ 0.725. Thus, K need never exceed 0.725, and will ordinarily be nearer, 0.375. L is the ratio of the horizontal component of the lifting force, $F_L$ to the vertical component $F_c$. When the lifting force, $F_L$, is provided by a block and tackle, $L$ 0; but when the lifting force is provided by a foot operated hoisting mechanism L will not only depend on the dimensions of various components of the foot operated hoisting mechanism but also on the dimensions of the lock as well as on the dimensions of upright. Moreover, when all of these parameters have been fixed, L will vary between fixed limits during the lifting stroke. For the design being used this information is contained in the following table:

| Upright Width | Max L | Min L |
|---|---|---|
| 3.250 | .238 | .122 |
| 3.375 | .239 | .123 |
| 3.500 | .229 | .114 |
| 3.625 | .191 | .076 |

The determination of the condition under which the lock will open when subjected to an upward lifting force is carried out with reference to FIG. 3. Here F represents the downward component and KF the horizontal component of the force exerted on the fulcrum 32 by the load on the platform. $F_c$ and $LF_c$ represent the vertical and horizontal components of the lifting force exerted at the trunnion axis 23. Similarly $F_a$ and $F_b$ are the horizontal forces exerted on the outer and inner jaws 26 and 27 by the upright while $uF_a$ and $uF_b$ ($u$ being the coefficient of friction, assumed to be the same on both sides of the upright) are the frictional forces exerted on the outer and inner jaws by the upright, assuming that the upward force $F_c$ is just sufficient to initiate slipping. The location of the trunnion axis and the inner and outer jaws with respect to the fulcrum 32 is indicated in FIG. 3 by $A_h$, $A_v$, $B_h$, $B_v$, $C_h$, and $C_v$. When the forces are such that the system is in equilibrium but just on the point of slipping upwardly along the post, $$F - F_c + uF_b + uF_a = 0 \qquad (1)$$

$$KF - LF_c + F_b - F_a = 0 \qquad (2)$$

and equating torques taken about the fulcrum, $$C_hF_c + C_vLF_c - B_huF_b - B_vF_b - A_huF_a + A_vF_a = 0 \qquad (3)$$

These equations may be rewritten, $$F_c - uF_b - uF_a = F$$

$$LF_c - F_b + F_a = KF$$

$$(C_h + LC_v)\,F_c - (B_v + uB_h)\,F_b + (A_v - uA_h)\,F_a = 0$$

Solving for $F_b$ by Cramer's rule we find, $$F_b = \frac{\begin{vmatrix} 1 & F & -u \\ L & KF & 1 \\ C_h + LC_v & O & A_v - uA_h \end{vmatrix}}{\begin{vmatrix} 1 & -u & -u \\ L & -1 & 1 \\ (C_h + LC_v) - & (B_v + uB_h) & (A_v - uA_h) \end{vmatrix}}$$

and expanding the determinants, $$F_b = F\,\frac{(K - L)\,(A_v - uA_h) + (1 + uK)\,(C_h + LC_v)}{B_v - A_v + uL\,\{A_v + B_v - 2C_v\} + u\,\{A_h\,(1 - uL) + B_h\,(1 + uL) - 2C_h\}} \qquad (4)$$

Now it is clear that whenever $F_b$ is positive there must be contact between the inner jaw and the upright. It is sufficient then to show that for the range of parameters encountered, $F_b$ is positive or zero. The following table gives the values of the parameters $A_h - C_v$ for the range of upright widths for which the lock can be used safely:

| Upright Width | $A_h$ | $A_v$ | $B_h$ | $B_v$ | $C_h$ | $C_v$ |
|---|---|---|---|---|---|---|
| 3.250 | 6.000 | 0 | 2.750 | 2.095 | 1.250 | .625 |
| 3.375 | 5.988 | .379 | 2.613 | 2.265 | 1.208 | .703 |
| 3.500 | 5.944 | .816 | 2.440 | 2.449 | 1.153 | .789 |
| 3.625 | 5.846 | 1.349 | 2.208 | 2.660 | 1.077 | .890 |

It remains then to determine the range of values of the coefficient of friction $u$ which may be encountered. We have found for oiled polished lumber, at one extreme, that $u \approx 0.125$ while on rough lumber or aluminum, $u$ will almost always be less than 0.400.

Turning now to equation (4), we observe that $B_r > A_r$, $B_r > 2C_r$, $> uL$ and $B_h > 2C_h$ so that the denominator of $F_b$ is always positive. Thus, a sign change in $F_b$ occurs only when its numerator changes sign. Now $K - L > 0$ and $(1 + uK)(C_h + LC_r) > 0$ so that $F_b$ can be negative only when $A_r - uA_h$ is negative.

It is clear then that the lock will open when lifted at the trunnion axis only for sufficiently large coefficients of friction on the smaller size uprights. It is found by actual calculation, for the upright width of 3.250 and the extreme values, $K = 0.725$, $L = 0.122$, and $u = 0.400$ that $F_b$ is still positive so that no lock opening will take place. When lifting is accomplished by a block and tackle, $L = 0$. In this case, however, only a very small load can be hoisted and it is no problem to insure that $K = 0.375$. Again, it is found that, even for the smallest upright, $F_b$ is always positive.

This analysis also explains what happens when the lifting force is applied to the fulcrum. Then $C_h = C_r = 0$ and $$F_b = \frac{(k - L)(A_r - uA_h)}{B_r - A_r + uL(A_r + B_r) + u\{A_h(l - L) + B_h(l + L)\}} \quad (5)$$

The denominator in this expression is always positive for the same reasons as before and we will get lost motion whenever $A_r - uA_h > 0$ since $K - L > 0$. This will always happen on the minimum size upright, since $A_r = 0$ then, and on the standard upright of width 3.500 whenever $u > 0.137$ and on the maximum size upright of width 3.625 when $u > 0.230$.

FIG. 11 illustrates an embodiment of the invention on which the load-activated lock is located at the bottom of the platform supporting frame 60. While not visible in FIG. 11, there is a second platform supporting frame identical to and spaced from the frame 60 shown in FIG. 11. Between the two frames are disposed the members 61 and 62 whose function corresponds to that of the rod 22 and yoke 22*a* in FIG. 1. The lock 63 is pivoted upon a fulcrum rod 64 which extends between the pair of identical supporting frames. The lock has an inner jaw 64, an outer jaw 66, and a trunnion bar 67. By applying a hoisting force to the trunnion bar 67, the lock and its associated bracket can be lifted without appreciable lost motion.

Because the invention can be embodied in varied physical forms, it is not intended that the invention be limited to the precise structures which have been described. For example, the outer jaw 44 can be secured to plates 41, 42 in other ways which permit it to be easily detached. Further, springs 30 and 31 are redundant and can be omitted without affecting the operation of the lock. As yet another example, the levers 47, 47*a* need not be locked to the plates 41, 42 by the means 53 here described as it is obvious that many other locking arrangements are available. In view of the various forms which the invention can take, it is intended that the invention be delimited by the appended claims and include within its scope only those structures which essentially are embodiments of the invention.

The embodiments of the invention in which an exclusive property or privilege is claimed are defined as follows:

1. In a scaffold bracket for use with an upright post, said bracket being of the type employing a rigid frame for supporting a platform, and a lock having side members, said rigid frame being supported by said side members in a manner permitting relative rotation only between said lock and said frame about a pivotal axis, said side members carrying an inner jaw and an outer jaw in a manner permitting the upright to be received between said jaws and said side members and causing said jaws to clamp said upright when a downward, oblique force is exerted upon the pivotal axis, said inner jaw being located between and below said pivotal axis and said outer jaw, when said lock is in the locked position, the improvement comprising attachment means on said side members, said attachment means being situated between the pivoted axis and said inner jaw and said attachment means being adapted to be engaged by a hoisting mechanism.

2. The improvement according to claim 1 wherein said rigid frame has means thereon to support said platform and said means to support said platform is disposed on the side of said post remote from said outer jaw.

3. The improvement according to claim 1 wherein said attachment means consists of a hole in each of said side members.

4. The improvement according to claim 2 wherein said attachment means consists of a hole in each of said side members.

5. In combination with a lever operated hoisting device, a scaffold bracket for use with an upright post, said bracket employing a rigid frame having means for supporting a platform and, a lock having means supporting said frame in a manner permitting relative rotation only between said lock and said frame about a pivotal axis, said lock having an inner jaw and an outer jaw spaced apart to receive the upright between them and clamp said upright when a downward, oblique force is exerted upon said pivotal axis, said inner jaw being located between and below said pivotal axis and said outer jaw, when said lock is in the locked position, and said bracket provided with a trunnion axis on the side of said inner jaw away from said outer jaw and adjacent said means for supporting said platform, a hoisting means having an operating lever, said hoisting means being connected to said trunnion axis.

6. In combination, a scaffold bracket, a locking mechanism, and a hoisting mechanism for use with an upright post, said bracket being of the type employing a rigid frame for supporting a platform and a lock having side members, said rigid frame being supported by said side members in a manner permitting relative rotation only between said lock and said frame about a pivotal axis, said side members carrying an inner jaw and an outer jaw in a manner permitting said upright to be received between said jaws and said side members and causing said jaws to clamp said upright when a downward, oblique force is exerted upon the pivotal axis, said inner jaw being located between and below said pivotal axis and said outer jaw, the improvement comprising attachment means on said side members, said attachment means being situated between the pivotal axis and said inner jaw and said attachment means being adapted to be engaged by said hoisting mechanism, said hoisting mechanism comprising a stirrup, a pair of spaced plates, an inner jaw and an outer jaw spaced from each other and connected to said spaced plates defining a space receiving said upright post, spaced levers connected to said spaced plates and having a foot engaging stirrup fixed to one end of spaced levers and spaced straps connected to the end of said levers remote from said stirrup, said spaced straps being connected to said side members at said lock.

7. A scaffold bracket comprising two spaced first plate-like members receiving an upright member therebetween, an outer jaw member fixed to said plate members and extending therebetween and engaging said upright member, an inner jaw member fixed to said plate-like members and extending therebetween, below said outer jaw member, said upright being received between said inner jaw member and said outer jaw member, fulcrum member fixed to said plate-like members on a side of said inner jaw member remote from said outer jaw and, means supporting a platform on said fulcrum member, two spaced second plate members receiving said upright member therebetween, a second outer jaw and a second inner jaw, said second inner jaw and said second outer jaw being fixed to said second plate-like members and extending therebetween and engaging sid uprights, said second inner jaw being disposed below said second outer jaw, first lifting strap connected to one said first plate member at a position between said fulcrum and said inner jaw at its first end, a second lifting strap connected to said other first plate member between said fulcrum and said inner jaw at its first end, axle attached to said second plate-like members and extending therebetween, and disposed on the side of said second inner jaw remote from said second outer jaw, first lever attached to one end of said axle and, a second lever attached to the other end of said axle, a stirrup member fixed to said second end of said levers and extending therebetween, the first end of said levers being pivoted to a second end of said lifting straps whereby said stirrup member can be moved up and down manually thereby moving said brackets up said upright member.

8. The bracket recited in claim 7 wherein a helical spring is supported on said axle member, one end of said spring being connected to the said second side plate between said second inner jaw and said axle, the second end of said spring engages means on said levers for urging said levers to swing upwardly.

9. The bracket recited in claim 8 wherein said helical spring has two spaced helical parts receiving said axle, each said helical part has a first end engaging one said plate and a second end engaging a member fixed to said levers and extending therebetween.

* * * * *